US008708535B2

(12) United States Patent
Dalsgaard

(10) Patent No.: US 8,708,535 B2
(45) Date of Patent: Apr. 29, 2014

(54) ILLUMINATION DEVICE WITH INTERLOCKED YOKE SHELL PARTS

(75) Inventor: Carsten Dalsgaard, Silkeborg (DK)

(73) Assignee: Martin Professional A/S, Aarhus (DK)

( * ) Notice: Subject to any disclaimer, the term of this patent is extended or adjusted under 35 U.S.C. 154(b) by 0 days.

(21) Appl. No.: 13/579,313

(22) PCT Filed: Feb. 11, 2011

(86) PCT No.: PCT/DK2011/050040

§ 371 (c)(1),
(2), (4) Date: Sep. 7, 2012

(87) PCT Pub. No.: WO2011/100972

PCT Pub. Date: Aug. 25, 2011

(65) Prior Publication Data

US 2013/0003372 A1 Jan. 3, 2013

(30) Foreign Application Priority Data

Feb. 16, 2010 (DK) ..... 2010 00127

(51) Int. Cl.
*F21V 21/14* (2006.01)

(52) U.S. Cl.
USPC ..... 362/418; 362/426; 362/249.1

(58) Field of Classification Search
USPC ..... 362/418, 419, 423, 425, 426, 190, 191, 362/249.02, 249.1, 249.09, 370, 371, 372
See application file for complete search history.

(56) References Cited

U.S. PATENT DOCUMENTS

| | | | | |
|---|---|---|---|---|
| 4,419,721 | A * | 12/1983 | Gregoire et al. | 362/368 |
| 5,590,955 | A | 1/1997 | Bornhorst et al. | |
| 6,213,626 | B1 * | 4/2001 | Qian | 362/413 |
| 2004/0228133 | A1 * | 11/2004 | Tsao | 362/418 |
| 2005/0047142 | A1 | 3/2005 | Lui | |
| 2006/0269278 | A1 | 11/2006 | Kenoyer et al. | |
| 2009/0231850 | A1 | 9/2009 | Rasmussen et al. | |
| 2009/0323364 | A1 | 12/2009 | Bornhorst et al. | |

FOREIGN PATENT DOCUMENTS

| | | |
|---|---|---|
| CN | 101430078 | 5/2009 |
| EP | 1001212 | 5/2000 |
| EP | 1898145 | 3/2008 |

OTHER PUBLICATIONS

International Search Report; International Application No. PCT/DK2011/050040; International Filing Date Feb. 11, 2011; 3 pages.

(Continued)

*Primary Examiner* — Laura Tso
(74) *Attorney, Agent, or Firm* — Blank Rome LLP

(57) ABSTRACT

The present invention relates to an illumination device comprising a base, a U-shaped yoke connected to and rotatable relative to the base and a head connected to and rotatable relative to the yoke. The U-shaped yoke comprise two upstanding arms and the head is mounted between the upstanding arms. The head comprises at least one light source generating a light and the yoke comprises two interlocked U-shaped yoke shell parts. The present invention relates also to a method of manufacturing such illumination device. The method comprises the steps of providing the base, providing the head and providing the yoke where the step of providing the yoke comprises the step of locking two yoke shell parts together across the entire width of said yoke.

15 Claims, 8 Drawing Sheets

(56) References Cited

OTHER PUBLICATIONS

Chinese Application No. 2011800066130; First Office Action; Dated: Oct. 18, 2013; 5 pages (with translation 4 pages).

Chinese Application No. 2011800066130; Search Report (Translation); Dated: Oct. 10, 2013; 1 page.

European Application No. 11744292; Extended European Search Report; Dated: Jun. 20, 2013; 6 pages.

* cited by examiner

ILLUMINATION DEVICE WITH INTERLOCKED YOKE SHELL PARTS

FIELD OF THE INVENTION

The present invention relates to an illumination device comprising a base, a U-shaped yoke connected to and rotatable relative to the base and a head connected to and rotatable relative to the yoke. The invention relates also to a method of manufacturing such illumination device.

BACKGROUND OF THE INVENTION

Moving head lighting fixtures are commonly known in the art of lighting and especially entertainment lighting. A moving head light fixture typically comprises a head having a number of light sources which creates a light beam and a number of light effect means adapted to create various light effects. The head is rotatably connected to a yoke, and the yoke is rotatably connected to a base, and the result is that the head can rotate and direct the light beam in all directions.

The competition in the market has traditionally been based on the optical performance of the moving head such as light output, number of light effects, color mixing etc. The competition in the market has lately changed such that parameters such as quality, serviceability and price have become the most important factors. There is thus a need for a competitive moving head lighting fixture with regard to quality, serviceability and price.

US2009154165 discloses a device for influencing a light beam including a primitive element and a housing which is arranged on a rotatable arm and which is rotatable with respect to the primitive element by means of one of the several drive units, and into which a light source for generating a light beam may be introduced, wherein at least one part of the control electronics for operating the device is arranged in the rotatable arm or in the housing.

EP 1898145 discloses a moving head projector comprising a base to which a yoke is rotationally connected, which yoke is rotationally connected to a head, which head comprises a light source placed partly inside a reflective means, which reflective means forms a light beam, which light beam passes through light forming means, which light beam furthermore passes through at least one lens before the light beam leaves the projector.

FR 2838178A discloses a spotlight having a face which supports a large number of red, green and blue light-emitting diodes which are controlled by an electronic circuit board at the rear to produce various color shades. The spotlight housing may be rotated about a horizontal axis by a motor and toothed belt and about a vertical axis by a motor and toothed belt.

EP 2103865 shows a system for rotating the head of a lighting fixture. A motor comprises a driving wheel, which driving wheel drives a belt, which belt is kept tight by a belt tensioner. The belt tensioner comprises a fixture and a tensioner wheel, which fixture is held under tension by a spring. An absolute encoding module comprises an input wheel driven by the belt. The input wheel rotates a first axle, which first axle rotates a second axle at a different speed. Furthermore, the belt drives a wheel connected to a head.

US2004/070984 discloses a luminaire including a base, a head comprising a lamp and an optical assembly and one arm connecting the base and the head. The arm has opposite first and second terminal ends rotatably coupled to the base and the head, respectively, first and second opposite sides extending between the first and second terminal ends, and first and second actuating members unitary with the arm. The first actuating member extends from the first side at the first terminal end and the second actuating member extends from the second side at the second terminal end. The first actuating member rotates the arm with respect to the base about a first axis, and the second actuating member rotates the head with respect to the arm about a second axis, perpendicular to the first axis. The head is only carried at one side and is thus carried in an unbalanced position. The consequence is that the bearings carrying the head will be worn out relatively fast and thus need to be replaced. Further the unbalanced head is hard to handle especially in connection with larger luminaries.

The prior art moving heads comprise many components and are thus rather complicated to manufacture which increases the price of the moving head and further complicates the serviceability of the moving head.

DESCRIPTION OF THE INVENTION

The object of the present invention is to solve the above-described limitations related to prior art. This is achieved by an illumination device and method as described in the independent claims. The dependent claims describe possible embodiments of the present invention. The advantages and benefits of the present invention are described in the detailed description of the invention.

DESCRIPTION OF THE DRAWING

FIG. 1*a* is a perspective view and FIG. 1*b* is an exploded view;

DETAILED DESCRIPTION OF THE INVENTION

The present invention is described in view of a moving head lighting fixture including a number of LEDs that generate a light beam. However, the person skilled in the art realizes that the present invention relates to illumination devices using any kind of light source such as discharge lamps, OLEDs, plasma sources, halogen sources, fluorescent light sources, etc.

Figure 1A:
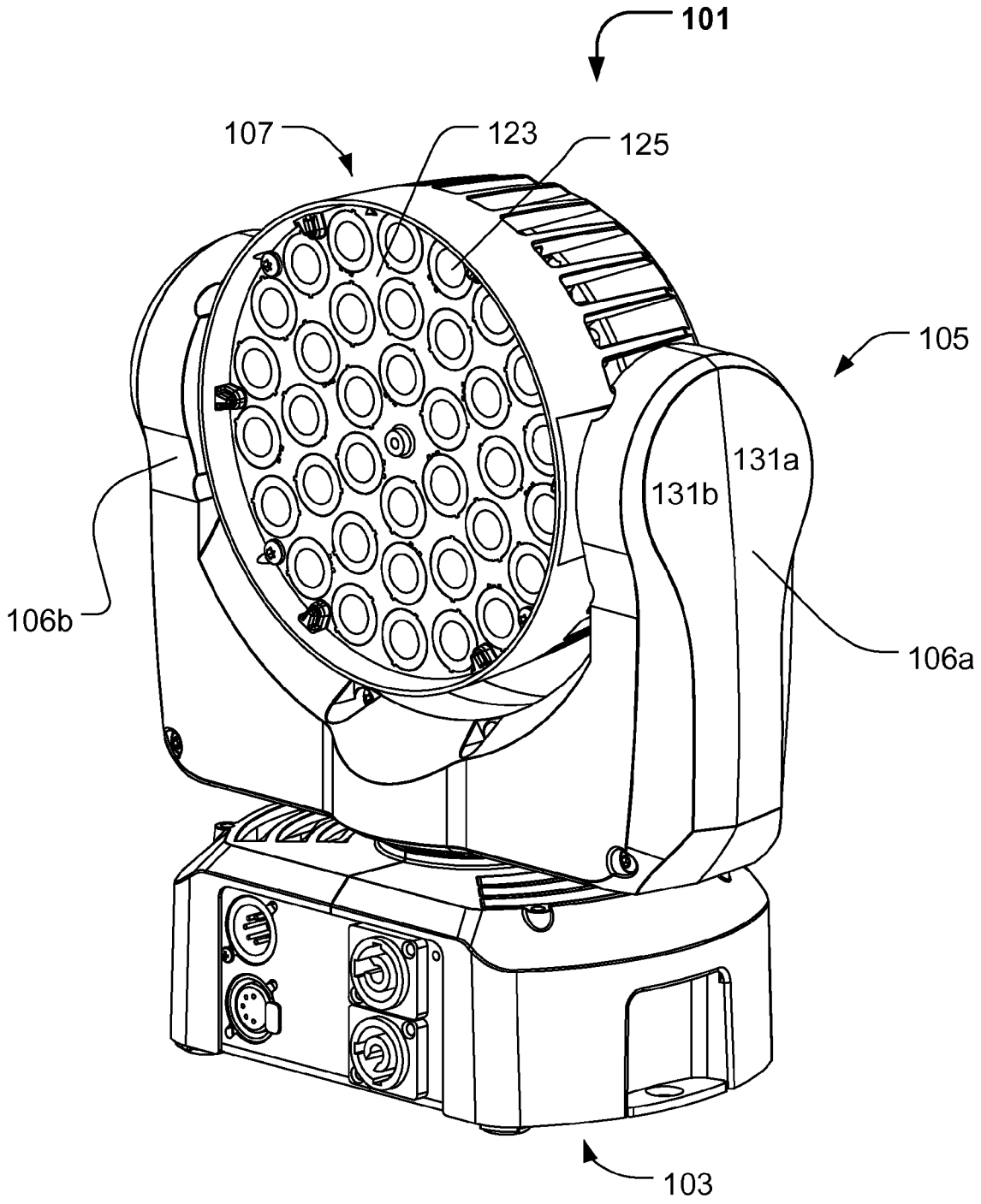
FIGS. 1*a* and 1*b* illustrate an illumination device according to the present invention where
Figure 1B:
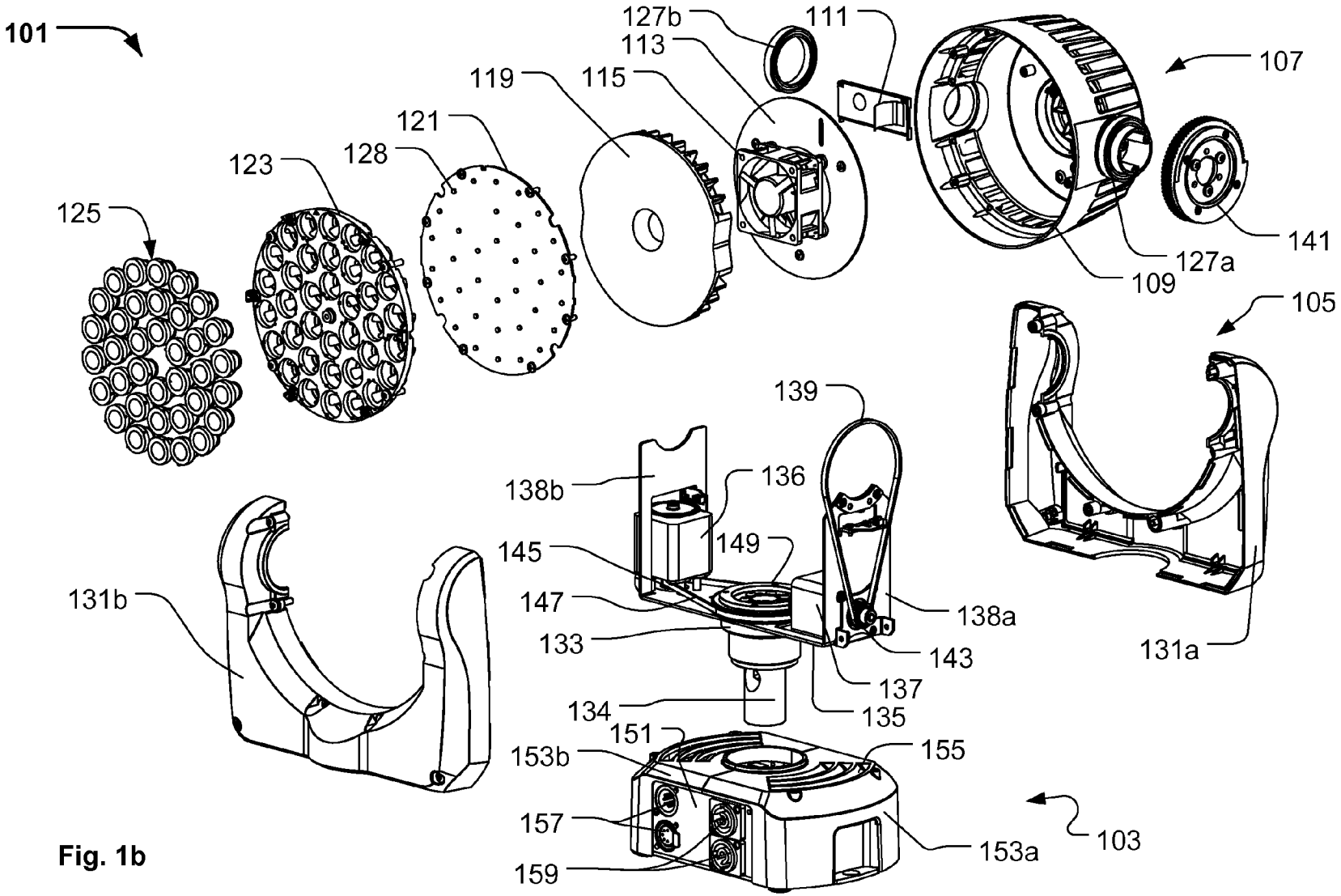

FIGS. 1*a* and 1*b* illustrate an illumination device according to the present invention where FIG. 1*a* is a perspective view and FIG. 1*b* is an exploded view. The illumination device is a moving head lighting fixture 101 comprising a base 103, a U-shaped yoke 105 rotatably connected to the base. The U-shaped yoke comprises two upstanding arms 106*a* and 106*b*. A head 107 is mounted between the upstanding arms 106*a* and 106*b* of the U-shaped yoke and is rotatably connected to the U-shaped yoke 105.

In the illustrated embodiment, the head is embodied as a "bucket" shaped head outer shell 109 wherein a display 111, main PCB (Printed Circuit Board) 113, a fan 115, a heat sink 119, an LED PCB 121, and a lens assembly are stacked. The lens assembly comprises a lens holder 123 and a lens array 125. The head is rotatably connected to the U-shaped yoke by two tilt bearings 127*a* and 127*b*, which are supported by the upstanding arms 106*a* and 106*b* of the U-shaped yoke as described in connection with the U-shaped yoke. The LED PCB 121 comprises a number of LEDs 128 emitting light and which in cooperation with the lenses 125 in the lens array generate a light beam. The main PCB comprises controlling circuits and driving circuits (not shown) for controlling the LEDs as known in the art of illumination devices. The main PCB comprises further a number of switches (not shown) which extend through a number of holes in the head outer shell 109. The switches and display act as a user interface allowing a user to communicate with the moving head lighting fixture.

The U-shaped yoke 105 comprises two U-shaped yoke shell parts 131*a* and 131*b* that are interlocked. Compared to the yoke of prior art moving head lighting fixtures, the U-shaped yoke can as a consequence be manufactured very fast and thereby reduce the price of the moving head lighting fixture. The two U-shaped yoke shells 131*a* and 131*b* are interlocked at both of said upstanding arms and across the entire width of the U-shaped yoke along an edge. The two yoke shell parts are thus brought together in a locked position where the yoke shell parts have at least one pair of edges that are positioned adjacent to each other whereby the yoke shells form a tight enclosure and add static strength to the construction. Interlocking the U-shaped yoke shell parts at both of the upstanding arms 106*a* and 106*b* of the U-shaped yoke provides a stiff construction as forces can be shared between the two upstanding arms. The yoke shell parts can be interlocked by fastening means such as screws, adhesive, or other kinds of engaging means. The entire width may be defined as the cross section having the largest dimension. This provides a stiff yoke construction as the U-shaped yoke shell parts are interlocked over a large dimension. The manufacturing process of this yoke is very fast since the components, which are to be positioned within the yoke, can be arranged in a first U-shaped yoke shell part 131*a* whereafter the second U-shaped yoke shell part 131*b* can locked to the first yoke shell part 131*a*. The U-shaped yoke shell parts form a monocoque shell which supports at least a part of the structural load provided to the U-shaped yoke. The strength of the interior yoke (metal) structure, which normally takes up the entire structural load in prior art yokes, can thus be reduced for instance by providing simpler structures or by reducing the thickness of the (metal) structure. The interior yoke structure can even in some embodiment be completely omitted. The cost of the interior yoke structure can thus be reduced as a simpler structure can be provided and less material is needed in order to provide proper support of the yoke. The U-shaped yoke shell parts 131*a* and 131*b* further fit together across the entire width of the U-shaped yoke whereby it is easier to ensure that the U-shaped yoke shell parts are locked together in a proper way. This can for instance be achieved by providing engaging means which ensure that the U-shaped yoke shell parts only can be locked together in one particular way. The engaging means used in the illustrated embodiment can be seen in FIGS. 3*a* and 3*b*. This decreases the probability that the U-shaped yoke shell parts are mounted wrongly which increases the quality of the product. The U-shaped yoke shell parts can further be identical which decreases the costs even more as only one molding tool is needed and the manufacturing process is further simplified as there is no need to keep track of two different yoke shell parts.

The U-shaped yoke shell parts are further connected to a pan bearing 133 rotatably connected to the base 103 through a shaft 134. The U-shaped yoke comprises in this embodiment a U-shaped metal frame 135 to which a pan motor 136 and tilt motor 137 are arranged. The tilt motor 137 is arranged on a first arm 138*a* of the U-shaped metal frame and connected to the tilt bearing 127*a* through a tilt belt 139. Tilt bearing 127*a* comprises further a toothed wheel 141 which is fixed to the rotating part of tilt bearing 127*a* and the head 107. The tilt motor comprises also a toothed wheel 143, and the tilt belt 139 is connected to the toothed wheel 141 of the tilt bearing and the toothed wheel 143 of the motor. The tilt belt comprises also a number tooth (not shown) which is adapted to engage the toothed wheels 141 and 143. The tilt motor will as a consequence be able to rotate the head in relation to the U-shaped yoke. It is to be understood that the tilt belt connection between the tilt motor and tilt bearing also can be embodied without the use of engaging teeth.

The pan motor 136 is arranged on a second arm 138*b* of the U-shaped metal frame 135 and connected to the pan bearing 133 through a pan belt 145. The pan bearing and pan motor both comprise a toothed wheel (145 and 147 respectively) interconnected by a toothed pan belt 149. The toothed wheel 145 of the pan bearing is fixed in relation to the base 103, and the pan motor can thus rotate the U-shaped yoke in relation the base. The U-shaped metal frame makes it possible to mount the components which are to be positioned inside the U-shaped yoke, such as pan motor, tilt motor, pan bearing, tilt bearing and other electronic or mechanical devices, before mounting the yoke shell parts. The U-shaped metal frame is a bent one-sheet metal plate which reduces costs since the U-shaped metal frame can be bent by a machine as known in the art of metal production. It is to be understood that the metal frame in other embodiments does not need to be U-shaped. The skilled person will also realize that the metal frame can be omitted in other embodiments and that the components which are to be positioned inside the U-shaped yoke can be mounted directly onto the U-shaped yoke shell parts prior to locking the yoke shell parts together. This can for instance be achieved by providing mounting guides such as flanges, spacers or holes in the yoke shell parts. The mounting guides can for instance be molded as a part of the yoke shell parts.

The base 103 comprises a one-sheet metal main base frame 151 and two base shell parts 153*a* and 153*b*. The two base shell parts are arranged on the metal main base frame and have vent holes 155 on top for air cooling. The base further comprises 5-Pin XLR male and female connectors 157 for DMX signals as known in the art; input and output power connectors 159, power supply PCB's (not shown) and fan (not shown).

Figure 2:
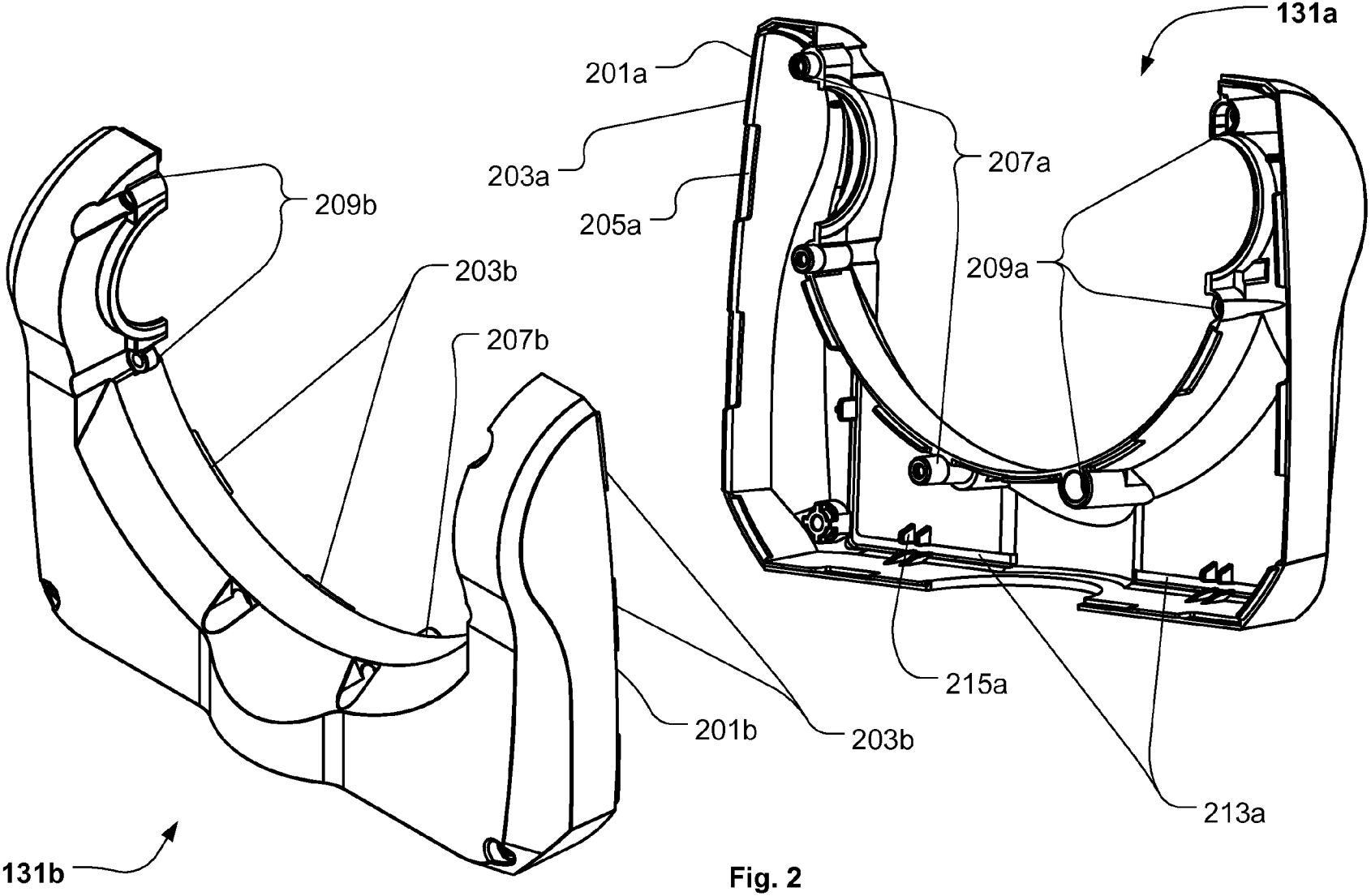
FIG. 2 illustrates a perspective view of two yoke shell parts 131*a* and 131*b* used in the illumination device in FIGS. 1*a* and 1*b;*

FIG. 2 illustrates a perspective view of the U-shaped two yoke shell parts 131*a* and 131*b*. The U-shaped yoke shell parts are molded in a plastic material and are identical, which reduces manufacturing costs as only one molding tool is needed. The U-shaped yoke shell parts 131*a* and 131*b* are interlocked along locking edges 201*a* and 201*b* of each yoke shell part. The locking edges are provided at both of said upstanding arms and extend across the entire width of the U-shaped yoke. The entire width may be defined as the cross-section having the largest dimension. This provides a stiff yoke construction as the yoke shell parts are interlocked over a large dimension. The stiffness of the construction is further increased due to the fact the locking edges 201*a* and 201*b* comprises at least two locking edge parts which are perpendicular to each other, as the bottom part of the yoke shell parts are substantially horizontal (with respect to the base) and the arm parts of the yoke shell parts are substantially vertical (with respect to the base). The monocoque shell constituted by the two U-shaped yoke shell parts is thus capable of supporting structural loads applied to the yoke and also resists twisting and bending.

The U-shaped yoke shell parts comprise engaging means adapted to engage with the other interlocked U-shaped yoke shell part. The engaging means function as guides which ensure that the two U-shaped yoke shell parts only can be locked together in the correct way. In the illustrated embodiment, the engaging means are embodied as a number of flanges 203*a* and 203*b* protruding from the locking edges 201*a* and 201*b* respectively. The flanges are adapted to engage with a corresponding number of recesses 205*a* (the recesses of U-shaped yoke shell part 131*b* are not visible) in the locking edge of the other U-shaped yoke shell parts. In the illustrated embodiment, the protruding flanges and recesses are positioned asymmetrically around the center of the yoke such that each flange will engage with an opposite recess when the two U-shaped yoke shell parts are positioned with the locking edges 201*a* and 201*b* in front of each other. The engaging means are further embodied as a number of bosses 207*a* and 207*b* protruding from the locking edges 201*a* and 201*b* respectively and a corresponding number of mating bores 209*a* and 209*b* integrated in the locking edges 201*a* and 201*b* respectively. The bores are further adapted to accommodate screws which are tightened into the bosses e.g. into a threaded hole or by forcing the screw directly into each boss.

The U-shaped yoke shell parts comprise also bearing guiding means embodied as arc-shaped flanges 211*a* and 211*b*. The bearing guiding means are adapted to hold the tilt bearing when the U-shaped yoke shell parts are interlocked and function further as belt tensioning means as explained in connection with FIGS. 4*a*-4*c*. Other embodiments of possible belt tensioning means are described in connection with FIGS. 4-6.

The U-shaped yoke shell parts comprise mounting guiding means adapted to support at least one component positioned within said yoke. The mounting guiding means can for instance be embodied as flanges, bosses, recesses or bores integrated into the internal side of the yoke shell part. The components can for instance be attached to these parts by using fastening means such as screws, adhesives, snap mechanisms etc. Mounting guiding means can also be shaped as partial cavities shaped to accommodate the components which are to be positioned inside the yoke. The illustrated U-shaped yoke shell parts comprise mounting guiding means in the form of a recess 213*a* for accommodating the U-shaped metal frame (shown in FIG. 1*b*), mounting guides such as a recess for accommodating the U-shaped metal frame and a number of flanges 215*a* supporting the metal frame. The recess and flanges simplify the manufacturing process, as they make it very easy to position the U-shaped metal frame in the yoke shell part.

Figures 3A, 3B:
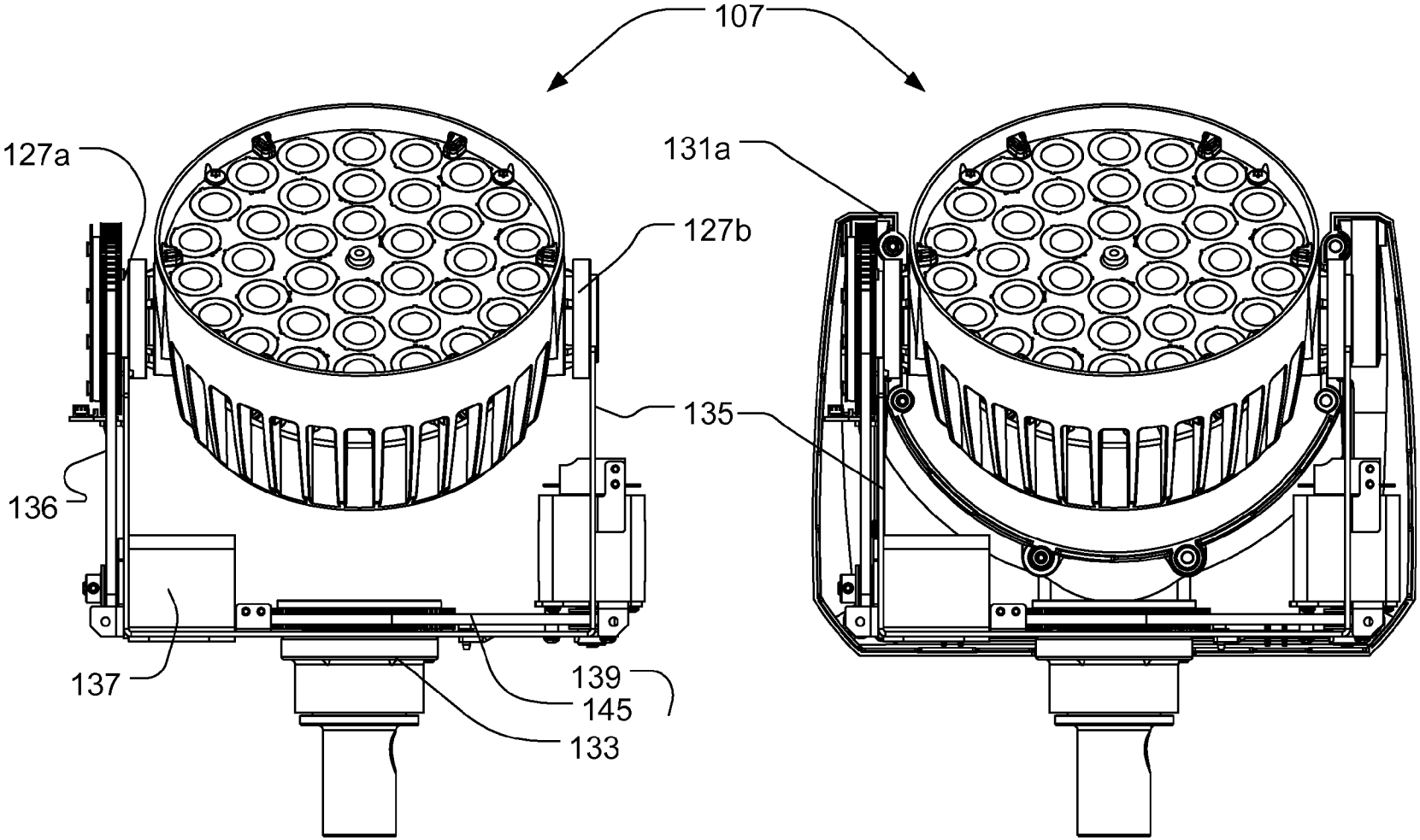
FIGS. 3*a*-3*b* illustrate steps of manufacturing the illumination device of FIGS. 1*a* and 1*b;*
Figures 4A, 4B, 4C:
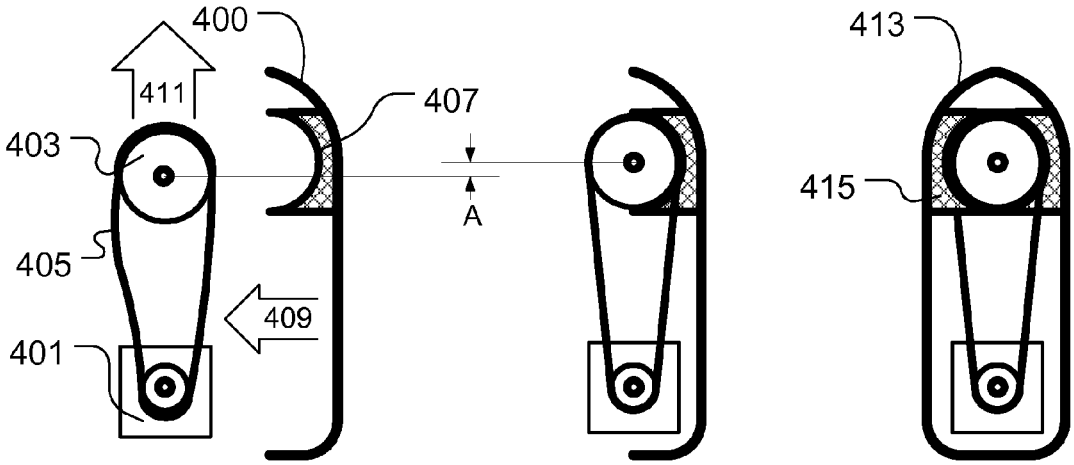
FIGS. 4*a*-4*c* illustrate a first embodiment of a yoke shell part comprising belt tensioning means.

The present invention relates also to a method of manufacturing an illumination device like the illumination device illustrated in FIGS. 1*a* and 1*b*. The method of manufacturing comprises the steps of providing the base, providing the U-shaped yoke and providing the head. FIGS. 3*a* and 3*b* illustrate the step of providing the yoke. FIG. 3*a* illustrates that the pan motor 136 is mounted to one yoke arm and the pan bearing 133 to the bottom part of the U-shaped metal frame whereafter they are connected by the pan belt 145. The tilt motor 137, tilt bearing 127*a* and tilt belt 139 are mounted on one arm of the U-shaped metal frame and a second tilt bearing 127*b* is mounted on the other arm of the U-shaped metal frame. The tilt bearings 127*a* and 127*b* are arranged on top of the U-shaped metal frame arm, and the tilt belt 139 is connected to the tilt motor 137 and the tilt bearing 127*a*. FIG. 3*b* illustrates that at least one component can be arranged within at least one of the U-shaped yoke shell parts prior to locking the two U-shaped yoke shell parts together. In the illustrated embodiment this is embodied by mounting the first U-shaped yoke shell part 131*a* on the U-shaped metal frame 135, whereby the U-shaped metal frame is arranged at least partially within the first U-shaped yoke shell part 131*a*. The U-shaped yoke shell part comprises belt tensioning means embodied as tilt bearing guiding means which are adapted to engage with the tilt bearings and lift the tilt bearing up from the U-shaped metal frame. In the illustrated embodiment, the tilt bearing is only lifted a few millimeters and FIGS. 4*a*-4*b* illustrate a simplified drawing of this functionality. The tilt belt is hereby tensioned and the tilt motor can rotate the tilt bearing and thus also the head in relation to the yoke. This reduces mounting time as the step of tensioning the tilt belt is performed as a part of the step where the first U-shaped yoke shell part is mounted on the U-shaped metal frame. The bearing guiding means are embodied as a number of arc-shaped flanges which are adapted to partly encircle the tilt bearing. The center of the arc-shaped flange is arranged higher in relation to the U-shaped metal frame than the center of the tilt bearings in relation the U-shaped metal frame, when the tilt bearing is arranged on the U-shaped metal frame. Thus the tilt belt will automatically be tightened when the first U-shaped yoke shell part is mounted on the U-shaped metal frame. This functionality is illustrated in further detail in FIGS. 4*a*-4*c*. A belt tensioning device as known in the art (for instance as disclosed in EP2103865A) can thus be eliminated, whereby both savings on the components and mounting time are achieved. The method of manufacturing comprises also the step of locking the second yoke shell part to the first shell part, whereby the yoke appears as illustrated in FIG. 1*a*. The two U-shaped yoke shell parts constitute now a monocoque shell which takes up at least a part of the structural load provided to the yoke. The second U-shaped yoke shell part comprises also tilt bearing guiding means which serve the same function as the tilt bearing guiding means of the first yoke shell part and thus secure the tilt bearing in a position where the tilt belt is held under tension.

FIGS. 4-7 illustrate the principles of different embodiments of possible belt tensioning means which can be integrated into the yoke shell part and adapted to tension a belt connecting a motor and a bearing upon mounting of the yoke shell part on the yoke. FIGS. 4-7 illustrate the principles behind the belt tensioning means and show a cross-sectional view of a yoke. It is to be understood that some components may be omitted for simplicity. The principles in FIGS. 4-7 are illustrated as belt tensioning means for a tilt drive comprising a tilt motor 401, a tilt bearing 403 and a tilt belt 405. The tilt drive is embodied in a yoke and adapted to rotate a head (not shown) in relation to the yoke. It is to be understood that similar principles can be used for any motor, bearing and belt systems, for instance a pan drive adapted to rotate the yoke in relation to the base.

FIGS. 4*a*-4*c* illustrate a yoke shell part where the belt tensioning mechanism is formed as bearing guiding means adapted to displace the bearing in relation to a motor upon mounting the yoke shell part 400 to the yoke. FIG. 4*a* illustrates the setup prior mounting the yoke shell part 400, FIG. 4*b* illustrates the setup after the yoke shell part 400 has been mounted on the yoke, and FIG. 4*c* illustrates the final setup. A tilt motor 401, a tilt bearing 403 and a tilt belt 405 are, in FIG. 4*a*, arranged in relation to each other such that the tilt belt is loosely looped around the tilt motor and the tilt bearing. The tilt belt, tilt motor and tilt bearing can for instance be arranged on a metal frame (not shown) as described above or arranged in another yoke shell part (not shown). The tilt motor comprises an axis which can be rotated by the motor, as known in the art. The tilt bearing is arranged such that it is possible to displace the tilt bearing in relation to the tilt motor for instance by positioning the tilt bearing on top of a metal frame as described above. The tilt bearing can also be mounted in a mechanical guide such as a guiding slot wherein the tilt bearing can move in relation the tilt motor. The bearing guiding means is formed as an arc-shaped flange 407 which is integrated as a part of the yoke shell part 400. The yoke shell part 400 is mounted on the yoke in a direction indicated by arrow 409 and the arc-shaped flange will engage with the tilt bearing and force the tilt bearing 403 in an upward direction as indicated by arrow 411 due to the shape of the flange. The tilt bearing is thus displaced a distance A in relation to the tilt motor whereby the tilt belt 405 is tensioned as illustrated in FIG. 4*b*. A second yoke shell part 413 is mounted and locked to yoke shell part 400 in FIG. 4*c*. The skilled person realizes that the bearing guiding means alternatively can be a curved surface that engages with the tilt bearing. The second yoke shell part comprises also bearing guiding means formed as an arc-shaped flange 415 which is integrated as part of the yoke shell part 413. The bearing guiding means 415 of the second yoke shell part secures the tilt bearing in the position where the tilt belt is tight.

Figures 5A, 5B, 5C:
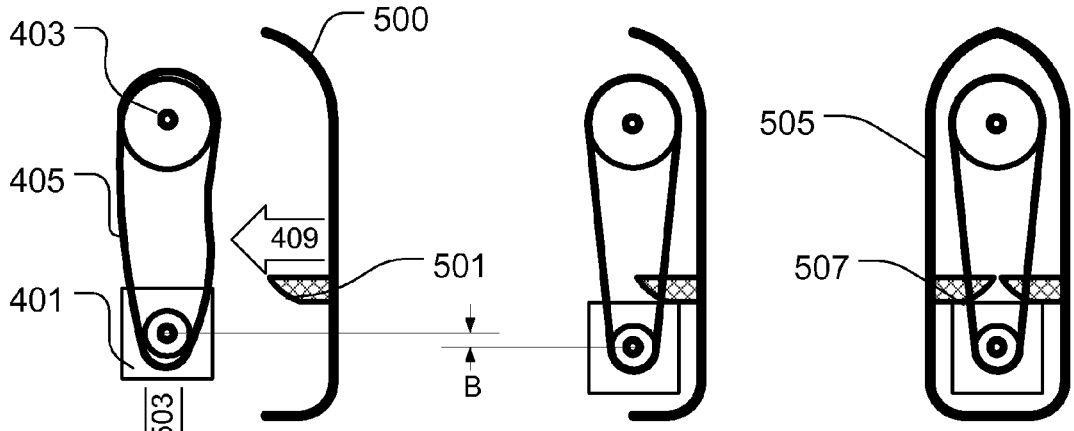
FIGS. 5*a*-5*c* illustrate a second embodiment of a yoke shell part comprising belt tensioning means.
Figure 6A:
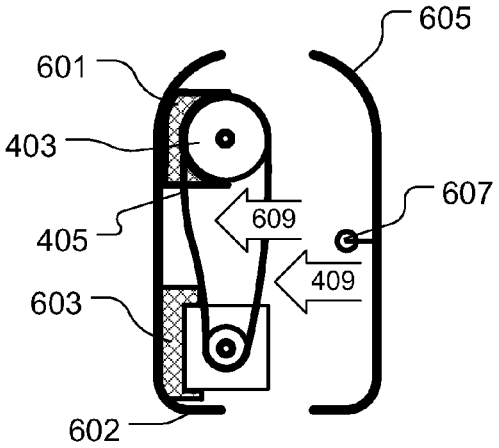
FIGS. 6*a* and 6*b* illustrate a third embodiment of a yoke shell part comprising belt tensioning means.
Figure 6B:
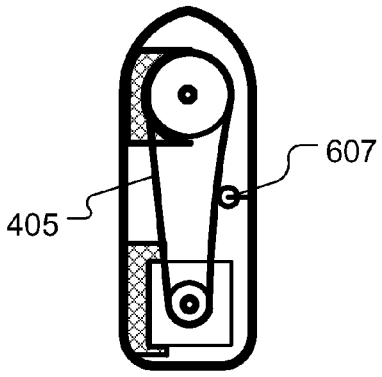

FIGS. 5*a*-5*c* illustrate a yoke shell part where the belt tensioning mechanism is formed as motor guiding means adapted to displace the motor in relation to a bearing upon mounting the yoke shell part to the yoke. FIG. 5*a* illustrates the setup prior mounting the yoke shell part 500; FIG. 5*b* illustrates the setup after the yoke shell part has been mounted on the yoke and FIG. 5*c* illustrates the final setup. In this embodiment the tilt motor is arranged such that it is possible to displace the tilt motor in relation to the tilt bearing for instance by arranging a part of the tilt motor in a mechanical guide such as a guiding slot wherein the tilt motor can move in relation the tilt bearing. The motor guiding means is formed as a curved flange 501 which is integrated as part of the yoke shell part 500. The yoke shell part 500 is mounted to the yoke in a direction indicated by arrow 409 whereby the curved flange 501 will engage with the tilt motor 401 and force the tilt motor in a downward direction as indicated by arrow 503 due to the shape of the curved 501 flange. The tilt motor is thus displaced a distance B in relation to the tilt bearing whereby the tilt belt 405 is tightened as illustrated in FIG. 5*b*. In FIG. 5*c* a second yoke shell part 505 is mounted on and locked to yoke shell part 500. The second yoke shell part 505 comprises also motor guiding means formed as a curved flange 507 which is integrated as part of the yoke shell part 505. The motor guiding means 507 of the second yoke shell part helps secure the motor in a position where the tilt belt is tight FIGS. 6*a* and 6*b* illustrate a setup where the tilt bearing 403 and tilt motor 401 are arrange in a first yoke shell part 601 using mounting guiding means 602 and 603, where guiding means 602 is adapted to accommodate the tilt bearing and guiding means 603 is adapted to accommodate the tilt motor 401. The mounting guiding means can be molded as part of the first yoke shell part 601 and formed to accommodate the tilt motor and tilt bearing. The guiding means can also include a snap mechanism adapted to hold the tilt motor or the tilt bearing in the mounting guiding means. In this embodiment the belt tensioning mechanism is formed as belt guiding means adapted to displace least a part of the belt upon mounting the yoke shell part 605 on the yoke. The belt guiding means are embodied as a pulley 607 connected to the yoke shell part 605. The pulley is adapted to displace a part of the tilt belt as indicated by arrow 609 by pushing to the tilt belt when the yoke shell part is mounted as indicated by arrow 409. The displacement of the tilt belt results in the fact that the path which the tilt belt follows when rotating is increased and the tilt belt is as a consequence tensioned as illustrated in FIG. 6*b*. The pulley ensures that the tilt belt can rotate without much friction. However, the skilled person realizes that the belt tensioning effect also can be achieved by a fixed mechanical mechanism without pulley. The pulley can also be spring-mounted on the yoke shell such that constant pressure is applied to the tilt belt.

Figure 7A:
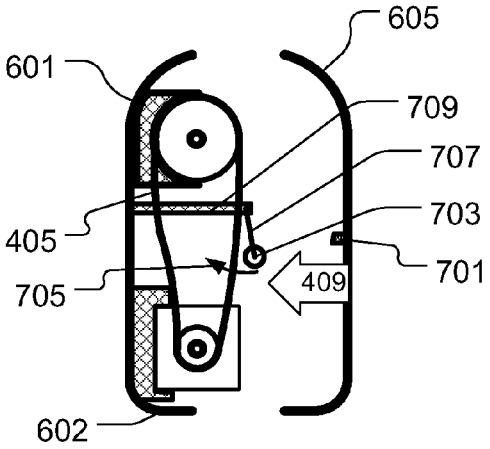
FIGS. 7*a* and 7*b* illustrate a fourth embodiment of a yoke shell part comprising belt tensioning means.
Figure 7B:
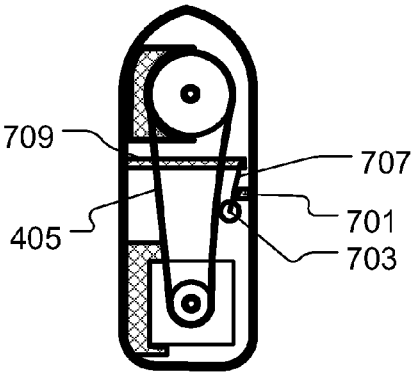

FIGS. 7*a* and 7*b* illustrate a setup similar to the one in FIG. 6*a* and FIG. 6*b* except for the fact that the belt guiding means are embodied as a protrusion 701 inside the second yoke shell part 605. The protrusion 701 is adapted to interact with a rotatable pulley 703 connected to the first yoke shell part 601. The pulley displaces a part of the tilt belt as indicated by arrow 705 by pushing on the tilt belt when the protrusion 701 interacts with the pulley upon mounting of the yoke shell part 605 as indicated by arrow 409. The pulley 703 is mounted on an arm 707 which is rotatably connected to mounting guide 709 of the yoke shell part 605. It is to be understood that the rotating pulley can be spring-loaded and also be arranged on a metal frame like the one illustrated in FIG. 1*b*.

It is to be understood that any combination of the principles illustrated in FIGS. 4-7 can be combined. The yoke shell part including belt tensioning means is illustrated in FIGS. 4-7 in connection with a yoke which is covered by two yoke shell parts. However it is further to be understood that the principles of the belt tensioning means also can be use in connection with yokes where the yoke shell parts that comprise the belt tensioning means only cover a part of the yoke and in connection with yokes where the yoke shell parts do not support a part of the structural load applied to the yoke.

It is to be understood that the principles of the belt tensioning mechanism integrated into the yoke shell part also can be used in an illumination device comprising a light source generating a light beam where the illumination device comprises at least one housing, and where the at least one housing comprises an outer shell comprising a number of shell parts surrounding at least one motor connected to a bearing through a belt wherein said at least one of the shell parts comprises belt tensioning means adapted to tighten said belt upon mounting of the shell part to the housing. The housing can for instance be an outer housing surrounding most of the components in the illumination device. The housing can also be a modular housing functioning as an internal housing surrounding a part of the components in the illumination device. The modular housing can for instance be a zoom system where a number of optical lenses are adapted to move along an axis for instance by using a motor belt mechanism whereby this belt mechanism can for instance be tightened by a belt tensioning mechanism integrated in a shell part surrounding at least a part of the components in the zoom module.

Figure 8A:
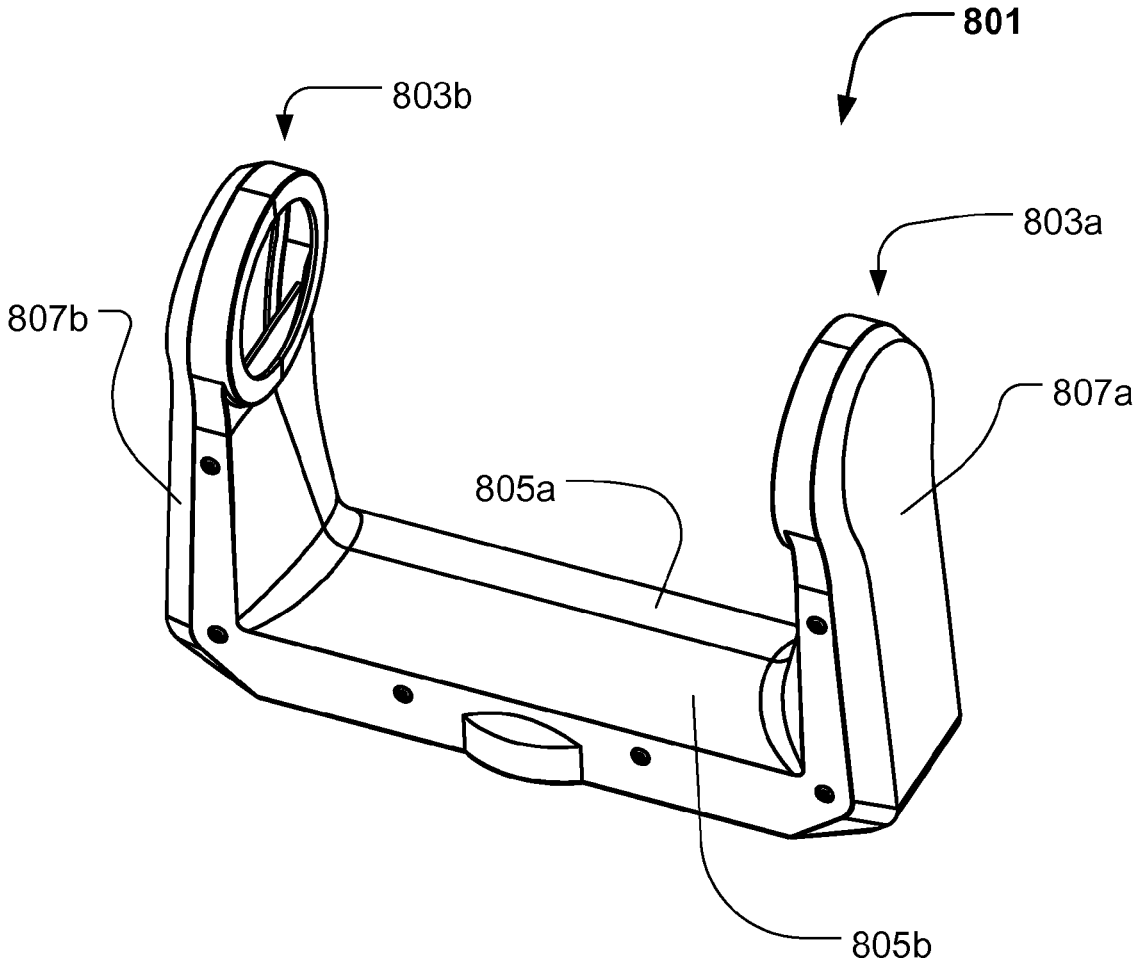
FIGS. 8*a* and 8*b* illustrate another embodiment of a yoke according to the present invention.
Figure 8B:
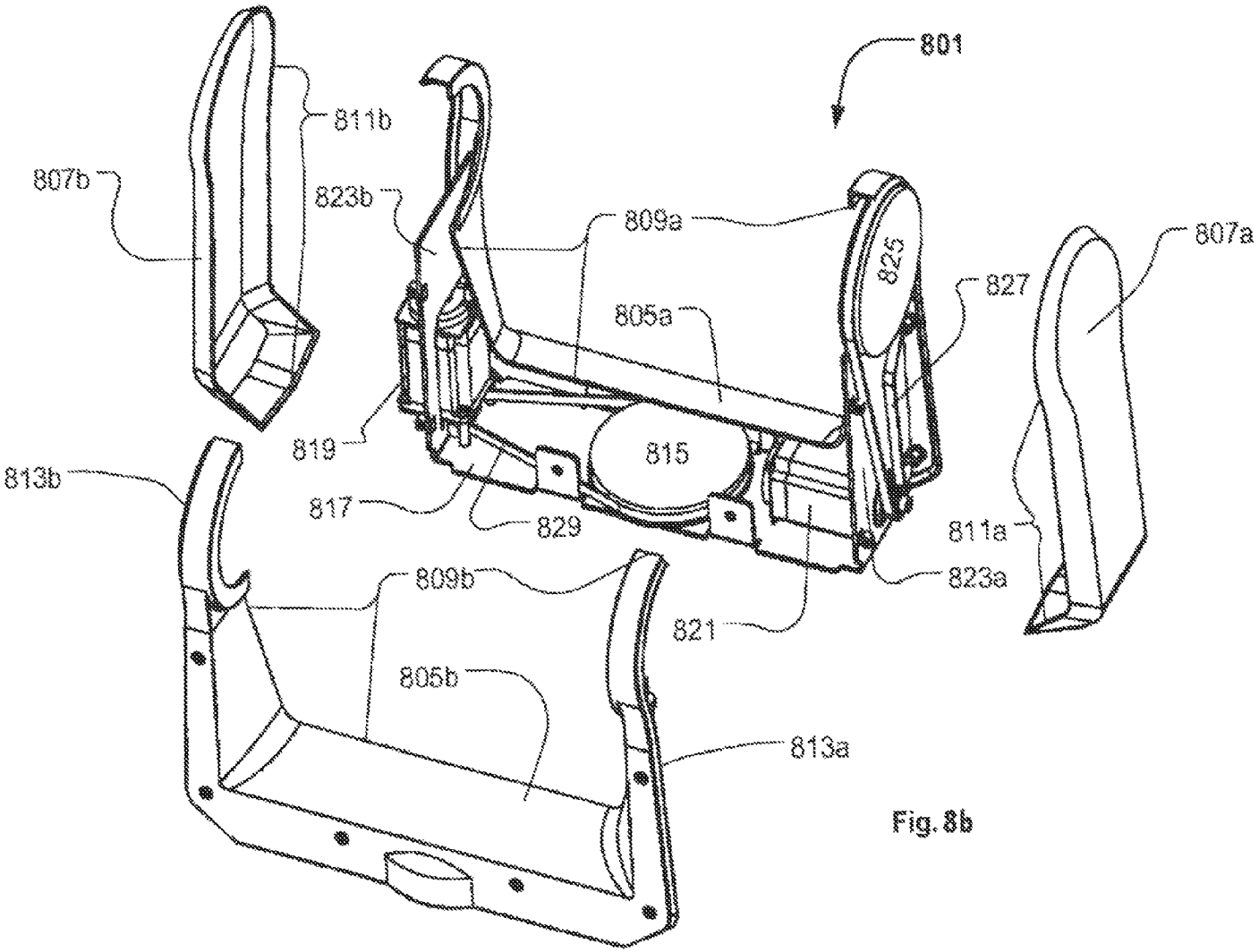

FIGS. 8*a* and 8*b* illustrate another embodiment of a yoke for an illumination device according to the present invention where FIG. 8*a* is a perspective view and FIG. 8*b* is an exploded view. The yoke 801 is U-shaped and comprises two upstanding arms 803*a* and 803*b* where a head (not shown) can be mounted such that it is rotatably connected to the U-shaped yoke 801. The U-shaped yoke 801 can further be rotatably connected to a base (not shown). In this embodiment the U-shaped yoke 801 comprises two U-shaped yoke shell parts 805*a* and 805*b* and two side shell parts 807*a* and 807*b*. The U-shaped yoke shell parts 805*a* and 805*b* are molded in a plastic material and are interlocked along a locking edge 809*a* and 809*b* of each yoke shell part. The locking edges are provided at both of said upstanding arms 803*a* and 803*b* and extend across the entire width of the U-shaped yoke. This provides a stiff yoke construction as the yoke shell parts are interlocked over a large dimension. The stiffness of the construction can be further increased by providing mating locking edge parts at the locking edges 809*a* and 809*b* as shown in FIG. 2. The two side shell parts 807*a* and 807*b* comprise locking edges 811*a* and 811*b* adapted to interlock with side locking edges 813*a* and 813*b* (only indicated at U-shaped shell part 805*b*) at the side of the U-shaped shell parts 805*a* and 805*b*. The consequence is that the two U-shaped yoke shell parts constitute a strong supporting structure and the side shell parts add further strength to the structure. The monocoque shell constituted by the two U-shaped yoke shell parts and the two side shell parts is thus capable of supporting structural loads applied to the yoke and also resists twisting and bending. One advantage of this embodiment is the fact that the side shell parts can be removed without the need for removing the U-shaped shell parts, which makes it possible to access the components mounted inside the yoke, e.g. for maintenance.

Like the yoke in FIG. 1*b* the U-shaped yoke shell parts 805*a* and 805*b* connect to a pan bearing 815 rotatably connected to the base (not shown) through a shaft (not shown). The U-shaped yoke 801 comprises in this embodiment a U-shaped metal frame 817 to which a pan motor 819 and tilt motor 821 are arranged. The tilt motor 821 is arranged on a first arm 823*a* of the U-shaped metal frame 817 and connected to the tilt bearing 825 through a tilt belt 827. The tilt motor will as a consequence be able to rotate the head in relation to the U-shaped yoke. The pan motor 819 is arranged on a second arm 823*b* of the U-shaped metal frame 817 and connected to the pan bearing 815 through a pan belt 829.

The invention claimed is:

1. An illumination device comprising:

a base;

a U-shaped yoke connected to and rotatable relative to said base, said U-shaped yoke comprised two upstanding arms;

a head mounted between said upstanding arms of said U-shaped yoke and rotatable relative to said yoke, said head comprising at least one light source generating a light;

wherein said U-shaped yoke further comprises at least two interlocked U-shaped yoke shell parts.

2. An illumination device according to claim 1 wherein said U-shaped yoke shell parts are interlocked at both of said upstanding arms.

3. An illumination device according to claim 1 wherein said U-shaped yoke shell parts constitute a monocoque shell, and said monocoque shell is adapted to support at least a part of a structural load provided to said U-shaped yoke.

4. An illumination device according to claim 1 wherein at least one of said interlocked U-shaped yoke shell parts comprises engaging means adapted to engage with the other interlocked yoke shell part.

5. An illumination device according to claim 1 wherein at least one of said interlocked U-shaped yoke shell parts comprises mounting guiding means adapted to support at least one component positioned within said yoke.

6. An illumination device according to claim 1 wherein at least one of said U-shaped yoke shell parts is connected to a pan bearing, said pan bearing being rotatable connected to said base through a shaft.

7. An illumination device according to claim 5 wherein at least one of said two U-shaped yoke shell parts comprise tilt bearing guiding means, and said tilt bearing guiding means is adapted to hold said at least one tilt bearing.

8. An illumination device according to claim 1 wherein said U-shaped yoke comprises a metal frame to which at least one of said two U-shaped yoke shell parts is connected.

9. An illumination device according to claim 8 wherein said metal frame is a bent U-shaped one sheet metal plate.

10. An illumination device according to claim 8 wherein at least one of said U-shaped yoke shell parts comprises a recess for accommodating said metal frame.

11. A method of manufacturing an illumination device, said illumination device comprising:

a base;

a U-shaped yoke connected to and rotatable relative to said base, said U-shaped yoke comprising two upstanding arms and two U-shaped yoke shell parts;

a head mounted between said upstanding arms of said U-shaped yoke and rotatable relative to said yoke, said head comprising at least one light source generating light;

said method comprising a step of:

locking said two U-shaped yoke shell parts together at both of said upstanding arms of said U-shaped yoke.

12. A method according to claim 11 further comprising a step of:

arranging at least one component within at least one of said U-shaped yoke shell parts prior to said step of locking said two U-shaped yoke shell parts together.

13. A method according to claim 11 further comprising a step of:

connecting said U-shaped yoke to said base and said head.

14. A method according to claim 13 wherein said step of connecting said U-shaped yoke to said base and said head further comprises steps of:

mounting a tilt bearing to said head; and positioning said tilt bearing on a U-shaped metal frame.

15. A method according to claim 14 wherein said step of locking said two yoke shells together comprises a step of:

lifting said tilt bearing from said U-shaped metal frame.

* * * * *